US007946565B2

(12) United States Patent
Kubota et al.

(10) Patent No.: US 7,946,565 B2
(45) Date of Patent: May 24, 2011

(54) BOOKBINDING APPARATUS AND IMAGE-FORMING SYSTEM EQUIPPED WITH THE SAME

(75) Inventors: Kazuyuki Kubota, Minamikoma-gun (JP); Kazuhide Sano, Minamikoma-gun (JP); Tadahito Takano, Fuefuki (JP); Shinya Sasamoto, Hokuto (JP); Yutaka Amemiya, Kofu (JP); Isao Kondo, Minamikoma-gun (JP); Kenichi Yoshimura, Kofu (JP)

(73) Assignee: Nisca Corporation, Minamikoma-gun (JP)

( * ) Notice: Subject to any disclaimer, the term of this patent is extended or adjusted under 35 U.S.C. 154(b) by 636 days.

(21) Appl. No.: 12/059,528

(22) Filed: Mar. 31, 2008

(65) Prior Publication Data

US 2008/0237962 A1 Oct. 2, 2008

(30) Foreign Application Priority Data

Mar. 29, 2007 (JP) ..... 2007-089282
Jul. 26, 2007 (JP) ..... 2007-194363

(51) Int. Cl.
*B65H 37/04* (2006.01)
*B41L 43/00* (2006.01)

(52) U.S. Cl. ... 270/39.01; 270/21.1; 270/45; 270/58.07; 270/58.08; 270/58.09

(58) Field of Classification Search ..... 270/21.1, 270/39.01, 39.06, 45, 58.07, 58.08, 58.09, 270/58.11; 493/352, 356
See application file for complete search history.

(56) References Cited

U.S. PATENT DOCUMENTS

2009/0035016 A1* 2/2009 Sanmiya et al. ..... 399/130

FOREIGN PATENT DOCUMENTS

JP 2008247533 A * 10/2008

* cited by examiner

*Primary Examiner* — Leslie A Nicholson, III
(74) *Attorney, Agent, or Firm* — Judge Patent Associates

(57) ABSTRACT

Imaging-system bookbinding apparatus avoids cutting any folded sheets mixed into booklets it trims. Furnished with: an imaging unit; a sheet-folding unit that folds imaging-unit sheets; a stacking unit that stacks sheets from the sheet-folding or image-forming units; a cover-sheet binding unit that encases stacking-unit sheet bundles with, and binds them into, cover sheets; a trimming unit that trims true the bundle fore-edge; and a fold-position computing unit that determines where a sheet is pleated by the sheet-folding unit. The sheet-folding unit has a sheet conveyance path along which folded sheets are transported elsewhere than the stacking unit, while the fold-position computing unit in a first control mode transports to the stacking unit sheets folded over by the sheet-folding unit, and in a second control mode transports them from the sheet conveyance path elsewhere than the stacking unit.

12 Claims, 10 Drawing Sheets

BOOKBINDING APPARATUS AND IMAGE-FORMING SYSTEM EQUIPPED WITH THE SAME

BACKGROUND OF THE INVENTION

1. Technical Field

The present invention, involving bookbinding apparatuses that bind a spine endface of sheet blocks having been collated into bundles and that finish the sheet bundles into booklets, relates to improvements in bookbinding apparatuses that aligningly stack into bundles sheets onto which images have been formed by, for example, a device such as an imaging apparatus, bind the sheets together into booklets, and trim the booklets' open edges true.

2. Description of the Related Art

Generally, this type of bookbinding apparatus is broadly known as a finishing device that collates into bundles sheets conveyed out from an imaging apparatus or similar source, and that bookbinding-processes the bundle by such operations as adhesive-binding, staple-binding, or adhesive-tape binding the bundle's spine edge. Furthermore, apparatuses furnished with a trimming unit that trims true the open edges of a sheet bundle (booklet bundle) having in this way been binding-processed, as well as apparatuses furnished with a sheet-folding unit, upstream of the sheet stacking tray where sheets are collated into bundle form, that folds sheets in half, in thirds, etc. are also known.

For example, Japanese Unexamined Pat. App. Pub. No. 2005-335262 discloses a bookbinding apparatus wherein sheets onto which images have been formed in an image-forming apparatus are conveyed to the bookbinding apparatus, and in the bookbinding apparatus the sheets are collated and stacked, an adhesive paste is applied to the endface of the spine portion of the sheet bundles, and the sheet bundles are encased with and bound into a cover sheet. The cover-sheet bound bundles are then spine-creased to post-process them into booklet form, and the sheet bundles now made into booklets are finished by trimming true their head/tail portions and fore-edge portions.

In another example, Japanese Unexamined Pat. App. Pub. No. 2006-076779 discloses a post-processing device that in a folding unit folds in half or in thirds sheets onto which images have been formed in an image-forming apparatus, collates the sheets into a stack and staples the stack closed. Therein, proposed are both single-folding, whereby a sheet is folded substantially in half over on itself, as well as Z-folding, whereby in divisions into thirds a sheet is folded inward and then is folded outward back onto itself. It is to be noted that for the sheet-folding device of this reference a trimming-cut configuration that trims true the open edges of sheets having been staple-bound is neither disclosed nor suggested.

As described above, for example, publications such as the foregoing JP 2005-335262 do propose bookbinding devices that collate into bundles (collating/stacking) sheets onto which images have been formed, bind a cover sheet to the spine-portion edge of the sheet bundles (spine-binding process), and then trim true the open edges of the encased bundle (trimming cut). Meanwhile, as bookbinding machines different from this sort of device, publications such as the foregoing JP 2006-076779 do propose bookbinding devices that fold sheets, conveyed out from an image-forming apparatus, in half or in thirds as needed (folding process), collate and stack the sheets (collating/stacking), and bind them together along the edge of the spine portion (spine-binding process).

Against this backdrop, the present inventors attempted the provision, in an image-forming system—like that of the foregoing JP 2005-335262—that collates sheets into bundles and encases the bundles into cover sheets to form booklets, of a device that folds collated sheets in half or thirds, processing them into booklets, and then trims true the open edges (head/tail portions and fore-edge portions). In doing so, however, they came up against the difficulty that in trimming the fore-edge true, the pleat-edge of sheets that had been folded would get sliced.

This slicing of folded sheets is caused by the fact that when trimming the edges of sheet having been formed into a booklet, the folded sheets are trimmed at the same time. A trimming cut on post-bookbinding sheets trims true, by slicing a predetermined amount off, the open edges of book-bound sheets, with as a reference either the sheet edges of the bound inner leaves having been encased into a cover sheet, or the cover sheet itself, whichever is shorter. To solve the fold-slicing problem, the pleat in a folded sheet presumably could be prepositioned in a location where it will not be trimmed off.

Nevertheless, when a sheet bundle is encased in a cover sheet and bound into a booklet, the fore-edge of the cover sheet will be indeterminate if the thickness of the sheet bundle (thickness when covered) is not preestablished. That is, the length from the spine-closure edge to the fore-edge of the cover sheet will differ depending on the sheet-bundle thickness (fore-edge length={cover-sheet size−bundle thickness}/2). Yet the fact that the thickness of a sheet bundle is detected at the stage where the sheets have been collated and stacked into a bundle on the stacking tray means that the final sheet bundle thickness when the sheets (for example the first sheet) have been fold-processed cannot be differentiated. Consequently, in instances where a folded sheet is mixed into a sheet bundle made into a booklet, trim-finishing the booklet after the bookbinding process invites the problems discussed above.

BRIEF SUMMARY OF THE INVENTION

The present invention provides a bookbinding apparatus and image-forming system that does not cut a folded sheet if one is included in a sheet bundle when trimming true the sheet edges of sheets that have been collated into a bundle and covered by a cover sheet. The present invention provides an image-forming system that forms images on a sheet fed from a sheet feeding portion provided inside the apparatus, and does not cut a folded sheet when the sheet is folded and finished into a booklet.

The present invention employs the following configuration to attain the aforementioned objects. The system is provided sheet folding means that folds sheets sequentially fed from a sheet conveyance path; stacking means that collates and stacks sheets fed from the sheet folding means and/or the sheet conveyance path; binding means that binds a spine edge portion of the sheet bundle conveyed from the stacking means; trimming means that trims edges of the bound sheet bundle to align edges; folding position calculating means that sets the folding position of the sheet folding means; and trimming amount calculating means that calculates a trim depth for trimming using the trimming means. When a sheet is folded into a Z-fold by the sheet folding means, the folding position calculating means is configured to set the inner folding position of the sheet backside based on the trim depth of the sheet fore-edge portion from the trimming amount calculating means.

Also, the folding position calculating means calculates so that the spine edge of the sheets and the length of the inner folded position are shorter than the sheet spine edge after the trimming finish and the fore-edge portion edge.

In the configuration described above, the stacking means stacks inner folded sheets conveyed from the sheet folding means, and inner single sheets that have not been folded, conveyed from the sheet conveyance path. A cover sheet feeding path that feeds cover sheets that cover the inner sheets fed from the stacking means is connected to the binding position of the binding process means. The trimming amount calculating means calculates the trim depth of the cover sheet from the preset bookbinding finishing size, and the trimming means cuts the edges of the sheet bundle at a longer trim depth of the cover sheet trim depth and the inner sheet trim depth.

The system is provided image-forming means that forms images on sheets based on predetermined image data; sheet folding means that folds sheets conveyed from the image-forming means; stacking means that collate and stack sheets conveyed from the sheet folding means or the image-forming means; cover sheet binding means that covers cover sheet over a sheet bundle conveyed from the stacking means; trimming means that trims the fore-edge portion of the sheet bundle bound with the cover sheet; and folding position calculating means that sets the folded position of the sheet folded using the sheet folding means. The sheet folding means is equipped with a sheet conveyance path that conveys a folded sheet to a location other than the stacking means. The folding position calculating means is furnished with a first control mode that conveys a sheet folded by the folding means to the stacking means, and a second control mode that conveys the sheet folded by the folding means to a location other than the stacking means from the sheet conveyance path. In such a case, the folding position calculating means is configured to set the folded position from a virtual trim depth cut by the trimming means when in the first control mode, and to set the folded position based on sheet size information received from the image-forming means when in the second control mode. The virtual trim depth is calculated based on the preset maximum tolerable booklet thickness, or sheet bundle thickness information attained from the number of sheets formed with images by the image-forming means.

The folded sheet position calculating means calculates the virtual trim depth from sheet bundle thickness information, sheet size information obtained from the image-forming means, and cover sheet size information, and sets so that the distance of the spine edge portion and length of the folded position is shorter than the distance of the spine edge portion and fore-edge portion edge after trimming.

The sheet conveyance path is configured to convey folded sheets to a stacking means that stores folded sheets, or to a finishing means that implements a finishing process such as punching holes therein, or stapling and the like.

The trimming means is provided trimming amount calculating means that sets the trim depth to trim and align the fore-edge portion of the sheet bundle covered by the cover sheet. The trimming amount calculating means sets the trim depth from the sheet bundle thickness obtained from the thickness detection means of a sheet bundle stacked in the stacking means, the length of the sheets formed with images by the image-forming means, cover sheet length, and a preset minimum trimming amount.

Sheet feeding means that feed sheets is equipped on the image-forming means. The image-forming means forms images on the sheet conveyed from the sheet feeding means to form a binding margin at the spine portion of the sheet, and a trimming margin at the fore-edge portion. The trimming margin is set to be larger than the virtual trim depth.

The image-forming means is provided with sheet feeding means that stores a plurality of sizes of sheets, and sheet feeding control means that selects and feeds one type of sheet from the sheet feeding means. The sheet feeding control means is configured to select a size appropriate for the image data from the sheets prepared in the sheet feeding means or a minimum sized sheet larger than that. The folding position calculating means calculates the preset maximum tolerable booklet thickness, or sheet bundle thickness information attained from the number of sheets formed with images by the image-forming means, and the virtual trim depth based on the sheet size information that is proper for the image data.

A bookbinding apparatus collates inner leaves of sheets conveyed from the image-forming apparatus into a sheet bundle and covers the sheet bundle with a cover sheet, the system being provided sheet folding means that folds sheets conveyed from the image-forming means; stacking means that collates and stacks sheets conveyed from the sheet folding means or the image-forming means; cover sheet binding means that covers a cover sheet over the inner leaves of sheets of the sheet bundle conveyed from the stacking means; trimming means that trims the fore-edge portion of the sheet bundle bound with the cover sheet; and folding position calculating means that sets the folded position of the sheet folded using the sheet folding means. The folding position calculating means calculates the virtual trim depth to cut using the trimming means from (1) inner sheet size information from the image-forming apparatus; (2) cover sheet size information; and (3) preset, tolerable maximum booklet thickness information, or thickness information of inner leaves of the sheet bundle calculated from the number of sheets formed with images. Also, the folding position calculating means sets the folding position so that the distance of the length of the spine edge and the folding position is shorter than the distance of the length of the spine edge and the fore-edge portion edge after trimming, based on the virtual trim depth.

It calculates based on the size of inner leaves of sheets that are not folded, when folded sheets from the sheet folding means and sheets that are not folded conveyed from the sheet conveyance path are stacked together in the stacking means and the folding position calculating means is calculating the virtual trim depth.

The cover sheet binding means is furnished with either one of a stapling means, adhesive application means, or adhesive tape binding means to bind a spine of a sheet bundle collated at the stacking means.

Also, the image-forming system according to the present invention is composed of an image-forming apparatus that forms images on sheets, and a bookbinding apparatus that collates sheets conveyed from the image-forming apparatus and binds them into a booklet. The folding position calculating means and trimming amount calculating means are disposed in the image-forming apparatus or the bookbinding apparatus.

The trimming amount calculating means calculates the trim depth to cut using the trimming means from the length information of the size of the finished booklet input using input means, length information of the sheet formed with images at the image-forming apparatus, and length information of the cover sheet supplied from said binding-process means.

A bundle thickness detection means that detects the thickness of the collated sheet bundle is provided between the stacking means and the cover sheet binding means, and the trimming means is provided trimming amount calculating means to trim and align the fore-edge portion of the sheet bundle covered by cover sheet at the cover sheet binding means. The trimming amount calculating means is configured to calculate the trimming amount from the size information of the inner sheets, the size information of the cover sheet, and the sheet bundle thickness detected by the bundle thickness detection means.

The image-forming system is provided image-forming means that forms images on sheets based on predetermined image data; sheet folding means that folds sheets conveyed from the image-forming means; stacking means that collates and stacks sheets conveyed from the sheet folding means or the image-forming means; cover sheet binding means that covers a cover sheet over a sheet bundle conveyed from the stacking means; trimming means that cuts the fore-edge portion of the sheet bundle bound with the cover sheet; and trimming position calculating means that sets the trimming amount of the fore-edge portion cut using the trimming means; and folding position calculating means that sets the folded position of the sheet folded using the sheet folding means. The sheet folding means is equipped with a sheet conveyance path that conveys a folded sheet to a location other than the stacking means. The folding position calculating means is furnished with a first control mode that conveys a sheet folded by the folding means to the stacking means, and a second control mode that conveys the sheet folded by the folding means to a location other than the stacking means from the sheet conveyance path. In such a case, the folding position calculating means is configured to set the folded position from a trim depth set by the trimming amount setting means when in the first control mode, and to set the folded position based on sheet size information received from the image-forming means when in the second control mode. The folding position in the first control mode is set so that the distance of the length of the spine edge and the folding position is shorter than the distance of the length of the spine edge and the fore-edge portion edge after trimming.

In an apparatus configuration that forms a booklet by collating and stacking sheets formed with image and covers the sheet bundle with a cover sheet, then trims edges thereof, the present invention has the following effects because the folding position calculating means that sets the sheet folding position sets the folding position based on a virtual trim depth by calculating the virtual trim depth from either a tolerable maximum booklet thickness or from the number of sheets calculated from image data, when sheets are folded by the sheet folding means disposed upstream of the stacking means.

It is possible to set the folding position folded by the folding means so that the distance of the length of the spine edge and the folding position is shorter than the distance of the length of the spine edge and the fore-edge portion edge after trimming, based on the virtual trim depth. In other words, the folded sheet folding position is set to inside the trimming margin so the fore-edge portion edge is not cut off when trimming to align that edge according to the thickness of the sheet formed with images on all sheets.

At the same time, even if sheets of various lengths are selected as folding sheets, it is possible to set the folding position to the predetermined position half position or ⅓ position. Also, when ⅓ folding specifications are applied, the folded piece does not project outward from the edge, so it is possible to for a booklet with a good finish. The fore-edge portion edge of all sheets including the folded sheets is trimmed, so an aesthetically appealing finish is possible when forming bookbinding.

Still further, the folding position calculating means that sets the folded position to fold the sheet using the sheet folding means of the present invention is composed of a first control mode and a second control mode. The first control mode sets the folded position from a virtual trim depth cut by the trimming means, and the second control mode sets the folded position based on sheet size information received from the image-forming means. This will not cut the folded position when trimming the sheet conveyed from the image-forming apparatus, and it is possible to attain the effect of folding a sheet at a predetermined folding position corresponding to the sheet size even when finishing without the trimming process (such as stapling and the like).

BRIEF DESCRIPTION OF THE SEVERAL VIEWS OF THE DRAWINGS

FIG. 4A shows a standard gate fold; FIG. 4B shows a Z-fold; FIG. 4C shows ¼ Z-fold.

FIG. 5A shows trimming at a width when a cover sheet is short compared to a bound sheet bundle; FIG. 5B shows trimming at a width when the bound sheet bundle is short compared to the cover sheet; and FIG. 5C is a perspective view of the entire action.

FIG. 6A is block schematic view of an adhesive container; FIG. 6B is an explanatory view of an operation of the applicator.

DETAILED DESCRIPTION OF THE INVENTION

Figure 1:
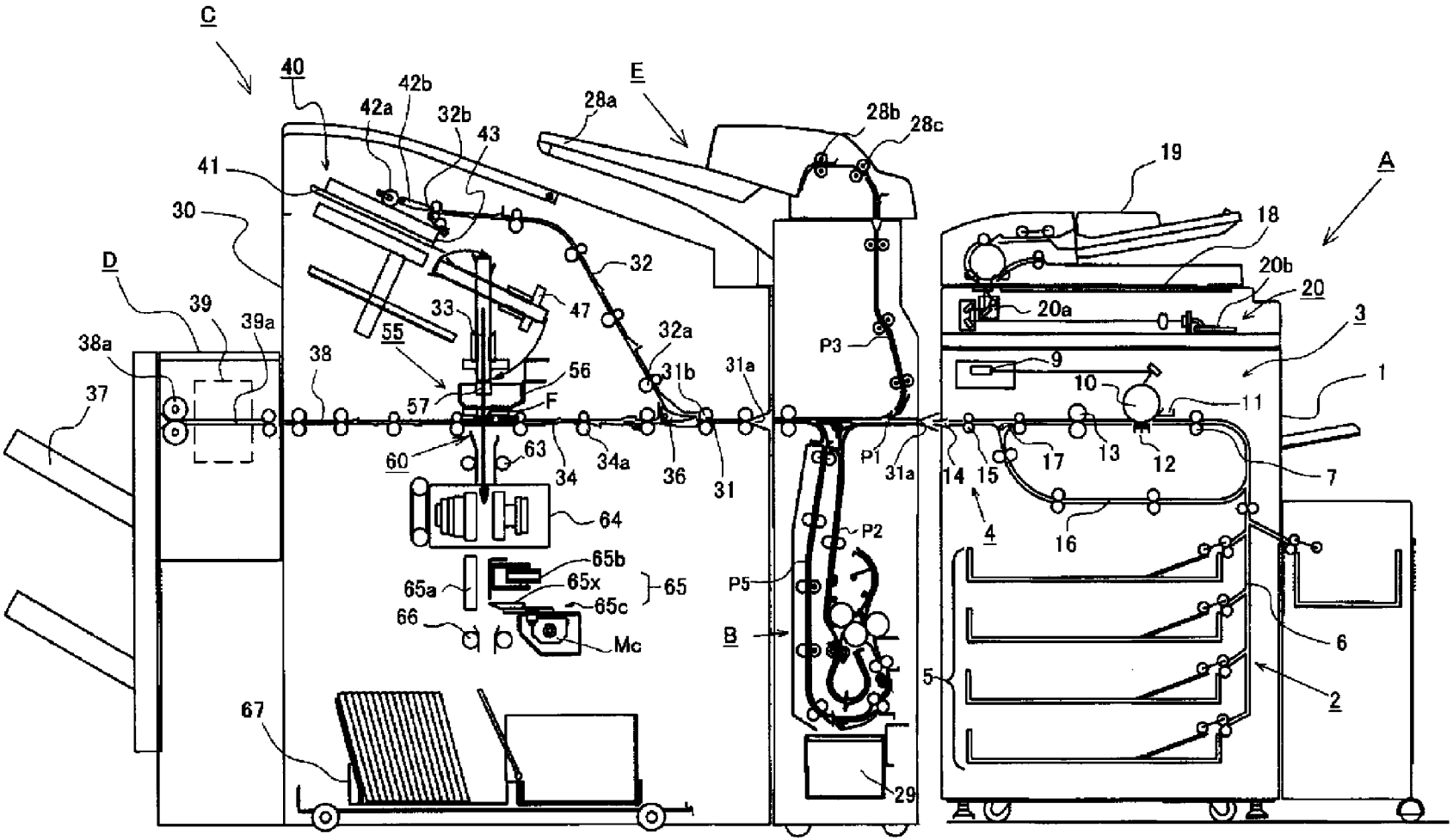
FIG. 1 is an explanatory view of an overall configuration of an image-forming system equipped with a bookbinding unit of the present invention.
Figure 2:
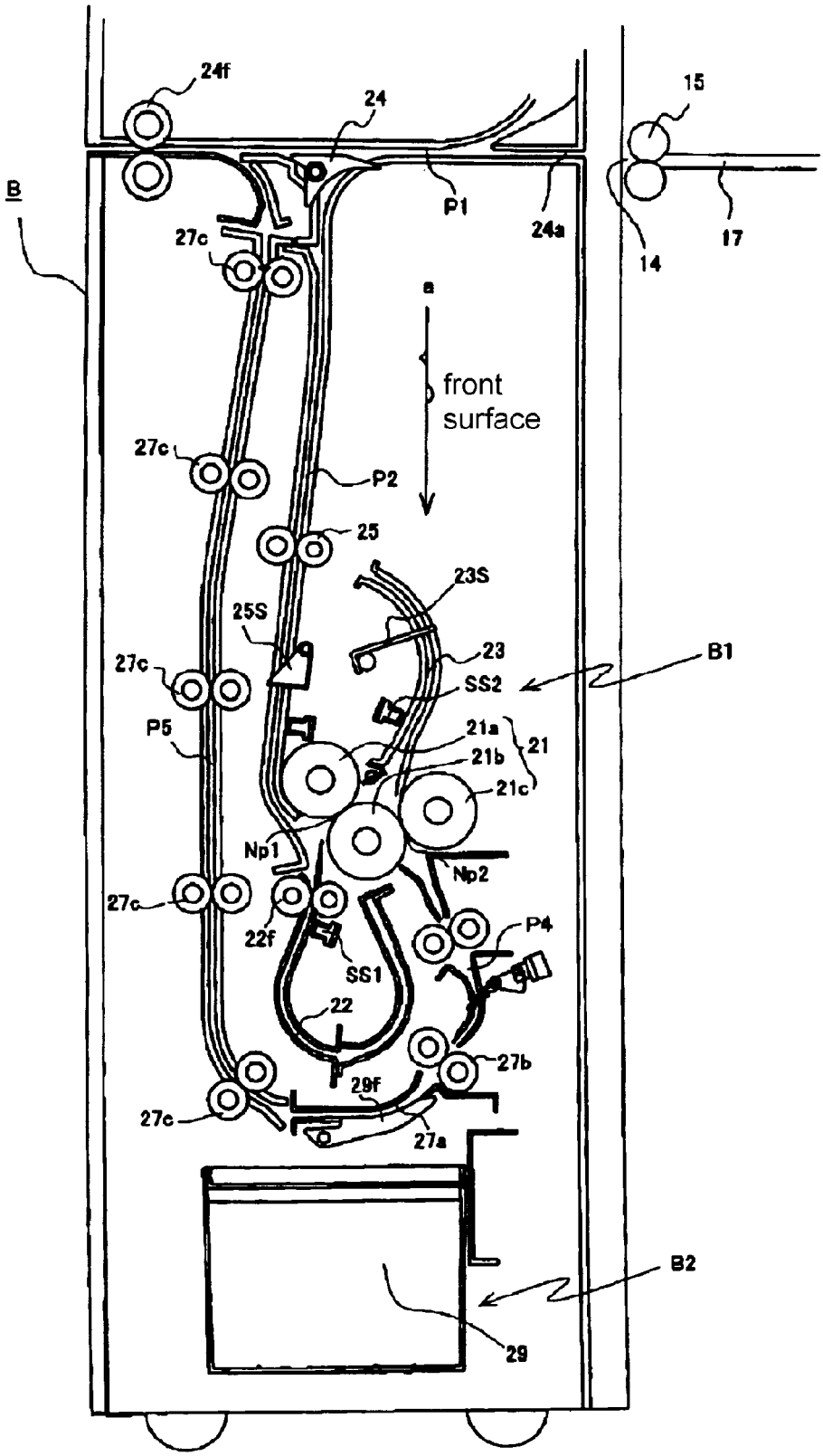
FIG. 2 is an explanatory view of a sheet folding unit in the system shown in FIG. 1.
Figure 3:
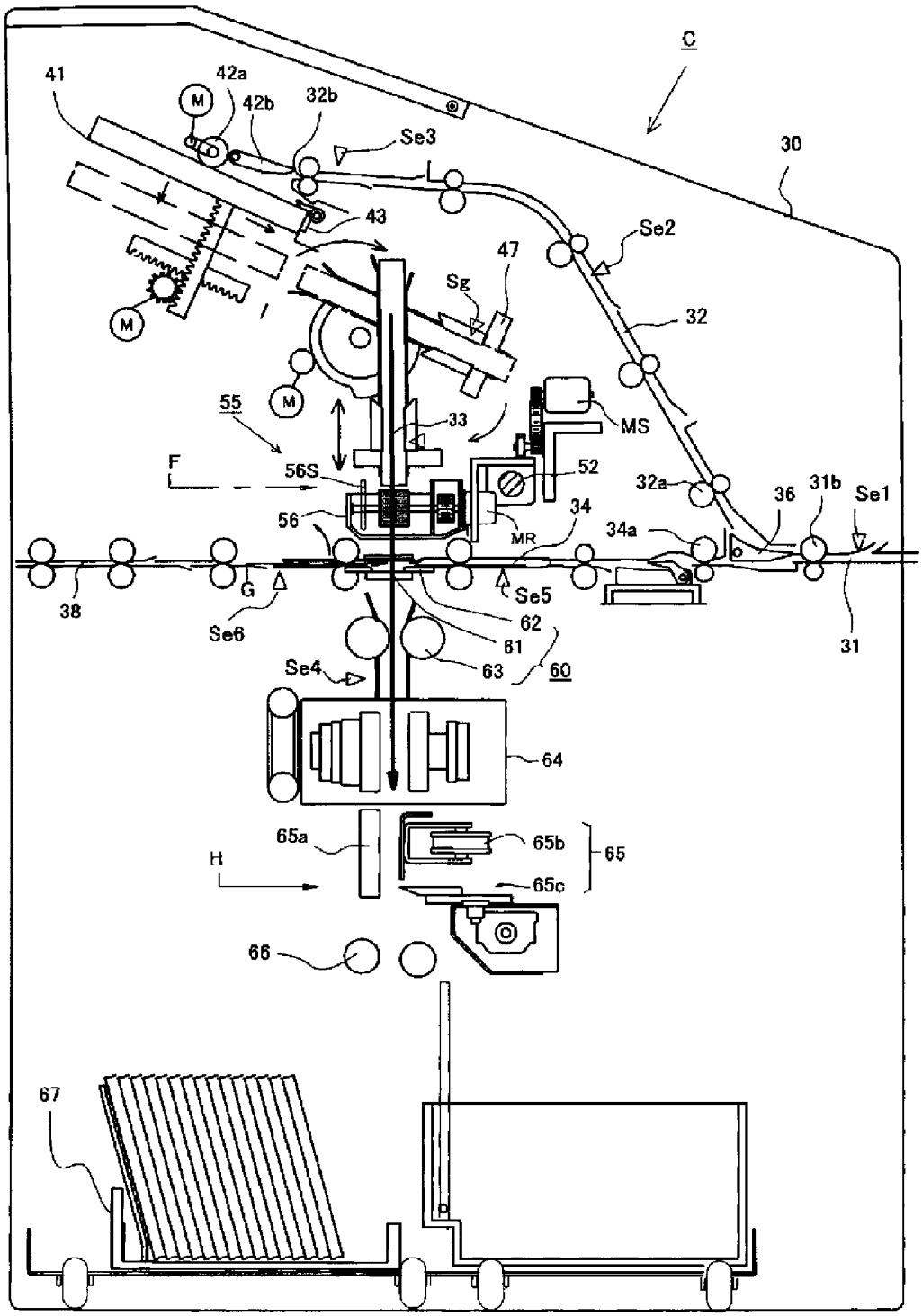
FIG. 3 is an explanatory view of a configuration of the bookbinding unit shown in FIG. 2.

A preferred embodiment of the present invention will be explained based on the drawings provided. FIG. 1 is an overall view of a configuration of the image-forming system according to the present invention; FIG. 2 is a view of a configuration of the sheet folding unit; and FIG. 3 is an explanatory view of a configuration of the bookbinding unit.

Configuration of Image-Forming System

The image-forming system shown in FIG. 1 is composed of an image-forming unit A that forms images on sheets; a sheet folding unit B that folds sheets formed with images into predetermined shapes; and a bookbinding unit C that performs a bookbinding process on sheets fed from these units. A finisher unit D is linked downstream of the bookbinding unit C. These units are disposed to convey sheets from the image-forming unit A sequentially downstream to the sheet folding unit B, the bookbinding unit C and then to the finisher unit D.

Detailed configurations of each unit will be described below. However, a feature of the present invention is that the image-forming unit A, the sheet folding unit B, and the bookbinding unit C are disposed downstream in that order. Also, as shown in FIG. 1, the image-forming unit A is equipped with an image-forming means 20 that sequentially forms images on sheets based on predetermined image data da1, and feeding means 2 that feeds sheets thereto. Also, the sheet folding unit B is equipped with a sheet folding means 21 that folds sheets formed with images. The bookbinding unit C is equipped with stacking means 41 that collates and stacks sheets fed from the image-forming means 20 directly or via the sheet folding means 21; cover sheet binding means 60 that covers the collated sheet bundle and binds a cover sheet thereto; and trimming means 65 that trims three edges of the sheet bundle bound with the cover sheet to align the edges. An inserter unit (feeding apparatus) E is disposed upstream of the cover sheet binding means 60 on an image-forming system having such a configuration, and in some cases the finisher unit D is disposed downstream of the bookbinding unit C. The inserter unit E feeds the cover sheet to the cover sheet binding means 60; the finisher unit D is equipped with a finishing means 39, such as stapling means that staples sheets, hole-punching means, and stamping means and the like, that aligns sheets fed from the image-forming means 20 or the sheet folding means 21 into a sheet bundle without the bookbinding process, and a discharge tray 37.

With such a system configuration, images are sequentially formed on sheets using image data da1 stored in a data storage unit provided in the image-forming unit A, or sent thereto, and these sheets are folded, collated and collected. Thereafter, the collated sheet bundle is covered by a cover sheet to form a book. After the bookbinding process, a finishing process to cut three sides of the sheet bundle, excluding the spine portion of the sheet bundle is possible. (Hereinafter, this is called a bookbinding operation.) At the same time, it is possible to feed sheets formed with images to the finisher unit D passing through the bookbinding unit C without their undergoing the bookbinding process and to be finished at the finisher unit with a process such as stapling, stamping, or hole-punching. (Hereinafter, this is called a finishing operation.) For that reason, in addition to folded sheets fed from the sheet folding unit B are sent to the stacking means 41, and a sheet conveyance path 38 is provided to convey the sheets to the finishing means 39. Therefore, it is possible to select whether sheets formed with images are sent either to the stacking means 41 via the sheet folding unit B for the bookbinding operation, or to the finisher unit D for the finishing operation.

The present invention has a feature to automatically execute processes with this system configuration from the image-forming process to the finishing process with the "print-out mode," "folding mode," "bookbinding mode," and "finishing mode." These modes can be set using a mode setting means 72, as described below, for example, but here the processes of each mode will now be explained.

Print-Out Mode

In this mode, sheets formed with images at the image-forming unit A are stacked on a discharge tray. This mode forms images on sheets of a size specified by the image data da1 in the same way as with an ordinary copier or printer, or of a size specified using an input means (a control panel 71 described below), and stacks and stores the sheets in the discharge tray. The system shown in FIG. 1 stores the sheets in the discharge tray 37 equipped on the finisher unit D at the furthest downstream side.

Folding Process Mode

In this mode, sheets formed with images at the image-forming unit A are folded for bookbinding or for finishing. Bookbinding folding specifications, staple folding specifications, and the letter folding specifications can be specified for the sheet folding method. Note that the system shown in FIG. 1 is configured so that a sheet folding process folds sheets fed from the image-forming unit A according to the specified folding specifications, and stores folded sheets in a folded sheet storage tray 29 (see FIG. 2), that is separate to bookbinding and finishing processes. Therefore, it is possible for the system to be set to bookbinding, finishing, or to sheet folding operations on sheets formed with images.

The present invention has a feature to determine the folding position N to fold the sheet according to the type of each final finishing process, of "bookbinding, finishing, and sheet-folding" when the system is set for the "folding process mode." Specifically, a folding position computing means 73 for determining folding position N when the above-described sheet folding means 21, disposed in the sheet folding unit B, folds sheets over is configured as follows to derive the folding position N in a first control mode and in a second control mode.

The first control mode sets the folding position N for the sheet when the "bookbinding finish" is set. This control sets the folding position N so that the folded edge of the folded sheet is not cut when a sheet bundle covered with a cover sheet bound by the bookbinding finish is being trimmed for alignment. For that reason, the folding position computing means 73 is composed to set the sheet folding position N based on a virtual trim depth, by computing the trim depth for bookbinding finish as the virtual trim depth.

Figure 5A:
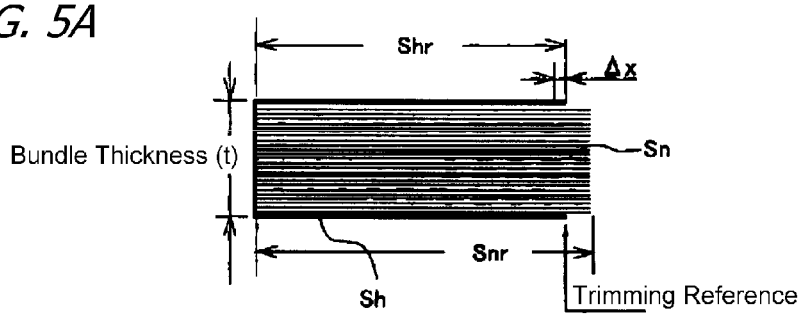
FIGS. 5A to 5C are explanatory views of states of trimming a sheet bundle in the unit shown in FIG. 3.
Figure 5B:
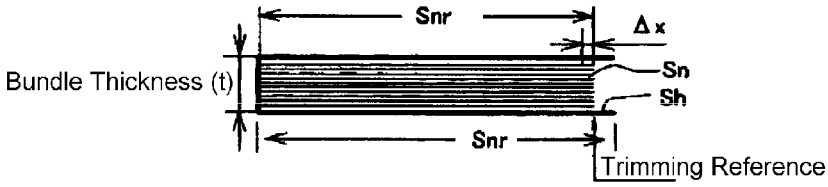

This virtual trim depth is computed in the following way, using initial setting conditions (setting values) for example for image forming. First, with the initial settings, the finishing mode selection, the sheet size selection and the image-forming area (page layout) are set. When supplying the cover sheet for the bookbinding finishing from the inserter unit E, the operator specifies the size of the cover sheet on the control panel 71. For the virtual trim depth, to begin with the lengthwise/widthwise orientation of the sheet is differentiated based on the page layout setting. The cover sheet, the longitudinal length L of the inner leaves of sheets, and the lateral length R are compared to set the trimming position based on the shortest sheet. This is to trim the sheets based on a small sized sheet to align the cover sheet and all the leaves of inner sheets (the sheet bundle). To explain this based on FIGS. 5A and (b), FIG. 5A shows a case where the cover sheet Sh is shorter compared to the inner leaves of the sheet bundle Sn; at that time, a minimum trim depth $\Delta x$ is set based on the cover sheet Sh. FIG. 5B shows a case where the inner leaves of the sheet bundle Sn are shorter compared to the cover sheet Sh; at that time, a minimum trim depth $\Delta x$ is set based on the inner leaves of the sheet bundle Sn.

Note that the comparison of the length between spine bound edge and fore-edge portion edge is calculated by [(sheet length−bundle thickness t)/2] for the cover sheet. In other words, to cover and bookbinding the inner leaves of the sheet bundle Sn with the cover sheet Sh, the cover sheet Sh is folded to form the spine cover at the central portion. The spine cover sheet width at this time substantially matches the thickness of the inner leaves of sheets of the bundle.

However, the spine cover sheet width (the thickness t of the sheet bundle of inner leaves) is determined when images are formed on the inner leaves of sheets to be aligned, and the sheet bundle is aligned in the stacking means. Meanwhile, in some cases there will be a sheet-folding process in which sheets, starting with the first for example, are fold-processed. Herein, when computing the virtual trim depth, the present invention features finding "bundle thickness (termed 'assumed bundle thickness' below) t" (1) from the maximum tolerable bookbinding thickness, or finding t (2) from the number of image-forming sheets. The former is set in advance from the apparatus configuration (for example, a maximum gripping amount of a gripping conveyance means 47, described below) of the bookbinding unit C. The latter is determined by multiplying an average sheet thickness (paper thickness) by the number of sheets to be printed that is known by the initial page layout settings.

Therefore, as shown in FIGS. 5A and 5B, the virtual trim depth is computed by subtracting the minimum trim depth Δx from the short length of either the length of the inner leaves of sheets or the cover sheet length, for the longitudinal length L in the top to bottom direction. The minimum trim depth Δx is subtracted from the shorter length by comparing the [(cover sheet length−assumed bundle thickness]/2] as the cover sheet lateral length (Shr) to the lateral length (Snr) of the inner leaves of sheets for the fore-edge direction horizontal length R. Note that in this case, the minimum trim depth Δx is set in advance based on an amount of position slippage generated in the sheets in the process for sheets formed with images at the image-forming unit A to be collated and stacked in the bookbinding unit C and covered with a cover sheet. In other words, the minimum trim depth Δx is set from the amount of misalignment of the top, bottom and open side that is generated in the cover sheet Sh and the inner leaves of sheets of the sheet bundle Sn that were bound by the cover sheet binding means 60, described below.

Next, the second control mode sets the folding position N for the sheet when "finishing·sheet folding" are set. This control calculates the folding position according to the preset folding specifications such as a half fold, a standard gate fold, and ⅓ Z-fold and the like which are described below. In such a case, the folding position computing means 73 is configured to calculate the folding position N from the folding specifications and the sheet size (the default value). Each folding specification will be described later.

Bookbinding Mode

This mode stacks and collates in stacking means 41 sheets fed from the image-forming unit A and dispenses adhesive (or adhesive tape) for example to the sheet bundle. Then, this sheet bundle is covered and bound by a cover sheet, and three sides, excluding the bound spine portion, of the sheet bundle are cut for alignment. A portion of the sheets stacked in this stacking means 41 are folded by the sheet folding means 21. Then, the sheet bundle formed into a cut and aligned booklet is stored in a storage stacker 67.

Finishing Mode

This mode conveys sheets from the image-forming unit A directly into a processing path (hereinafter referred to as a finishing path 39*a*) via the bookbinding unit C after being folded at the sheet folding unit B. After undergoing a finishing process by the finishing means 39, such as a stapling means, stamping means or a hole-punching means and the like prepared in this path, the sheets are conveyed out to the discharge tray 37.

Image-Forming Apparatus Configuration

The following will now explain the image-forming unit A shown in FIG. 1. The image-forming unit A can adopt a variety of structures of a copier, printer or printing machine. The drawing shows an electrostatic printing system. This image-forming unit A has a feeding unit (feeding means) 2, printing unit 3, discharge unit 4 and control unit in the casing 1. A plurality of cassettes 5 corresponding to sheet sizes is prepared at the feeding unit (feeding means) 2. Sheets of the size specified by the control unit are fed to the sheet feed path 6. A registration roller 7 is equipped at the sheet feed path 6. After the leading edge of the sheet is registered by this roller, it is fed at a predetermined timing to the downstream printing unit.

A static electric drum 10 is equipped at the printing unit 3. A print head 9, a developer 11 and a transfer charger 12 are disposed around this drum 10. The print head 9 is composed of a laser emitter, for example, to form electrostatic latent images on the electrostatic drum 10. Toner ink adheres to the latent image at the developer 11, and is this is transferred and printed on the sheet at the transfer charger 12. The printed sheet is the fixed at the fixer 13 and discharged to the discharge path 17. A discharge outlet 14 formed in the casing 1 and a discharge roller 15 are disposed at the discharge unit 4. Note that the symbol 16 in the drawing represents a recirculation path. A printed sheet from the discharge path 17 is turned over from front to back at the switchback path and fed to the registration roller 7 to be formed with images on its backside. In this way, a sheet formed with images on one side or both sides is conveyed from the discharge outlet 14 by the discharge roller 15.

Note that the symbol 20 in the drawing is a scanner unit (image-forming means). This optically reads original images to print using the print head 9. As is generally known in the art, the scanner is composed of a platen 18 where an original sheet is set; a carriage 20*a* that scans the original image along the platen 18; and an optical reading means (for example, a CCD device) 20*b* that photo-electrically converts optical images received from the carriage 20*a*. The drawing shows an original feeding apparatus 19 that automatically feeds the original sheet to the platen, installed over the platen 18.

Sheet Folding Unit Configuration

The following will now describe the configuration of the sheet folding unit B. The sheet folding unit B is composed of a folding unit B1 and a folded sheet stacker B2. A conveyance inlet 24*a* linked to a discharge outlet 14 of the image-forming unit A is equipped in the sheet folding unit B, and a sheet conveyance path P1 that sends sheets from the conveyance inlet 24*a* to the bookbinding unit C, described below, is connected to traverse the apparatus. A folding process path P2 and a sheet feed path P3 are branchingly connected to the sheet conveyance path P1.

Explanation of Sheet Folding Specifications

The following will now explain the folding specifications performed by the sheet folding unit B1. Folding sheets in half or in thirds are the types of folds (folding specifications) that are commonly applied with the image-forming system described above. Each type of sheet fold will now be explained.

Single Fold

This creases or folds a sheet conveyed out from the image-forming unit A at substantially the half position of the length of the direction of conveyance. Although not shown, the sheet is folded in half at a central position. The folded ends of sheets can then be bound by stapling or gluing and the like to form a closed-end document. Furthermore, if holes are punched into the folded sheets, they can be used in a variety of document organizing methods, such as filing. The folding position computing means 73 that sets the folding position N uses the first control mode for the bookbinding operation, and the second control mode for the finishing and sheet folding operations.

Gate Fold

Figure 4A:
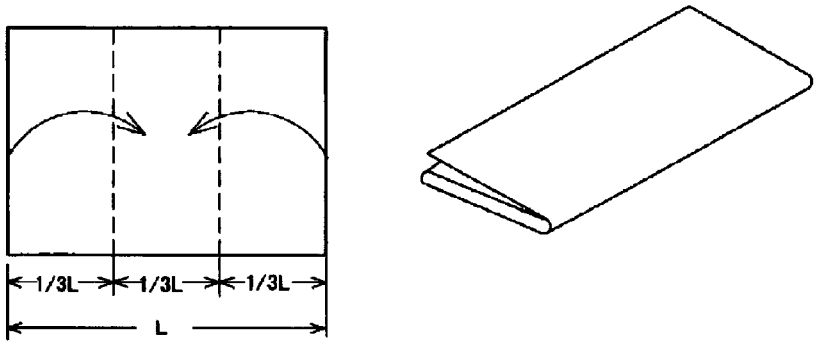
FIGS. 4A to 4C are explanatory views of types of sheet folds in the unit shown in FIG. 2.

In this folding method, the sheet is folded at desired positions (for example at ⅓ positions) of the leading edge and the trailing edge of the sheet in the length direction. The two end panels, specifically, the leading and trailing ends of the sheet, are mutually folded inward over a middle third panel. As shown in FIG. 4A, the leading end side of the sheet (in direction of sheet conveyance) is folded at a ⅓ position of the sheet, then the trailing end is folded over that panel at a ⅓ position of the sheet. A gate-folded sheet can be inserted into an envelope as a letter. Therefore, with this folding specification, folded sheets are stored a folded sheets in a sheet storage tray 29 equipped on the sheet folding unit B. In such a case, the folding position computing means 73 sets the folding position with the second control mode.

Z-Fold

Figure 4B:
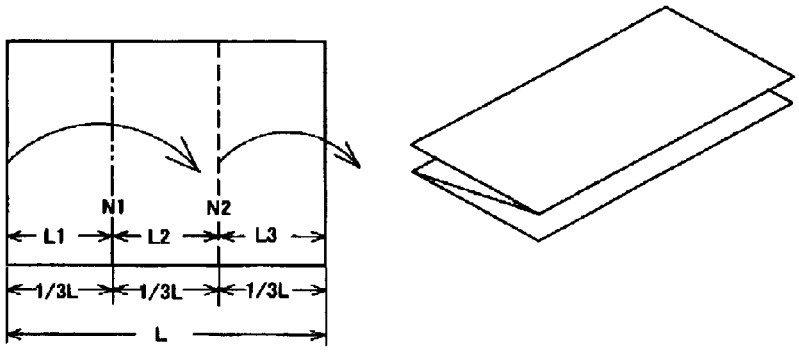

In this folding method, the sheet is folded at desired ⅓ positions of the leading edge and the trailing edge of the sheet in the length direction of sheet conveyance. Specifically, the leading and trailing ends of the sheet are folded in opposite directions. The leading edge of the sheet is folded inward, and the trailing edge of the sheet is folded outward. If a sheet is folded at ⅓ positions as shown in FIG. 4B, it can be inserted into an envelope as a letter. If the sheet is folded at a half position inward, and a ¼ position is folded outward, the sheet can be used for filing. Note that the sheet can be folded for any kind of use by adjusting the inner folding position (N1 in the drawing) and outer folding position (N2) when apply such a Z-fold. For example, if the inner folding position N1 is set to ⅓ of the sheet length L, leaving a binding margin at the spine portion, bookbinding is possible. If the folding back position (outer folding position) N2 of the edge is adjusted, it is possible to project the folded back portion so that a letter head portion of the sheet is facing outward so as to be visible.

Figure 4C:
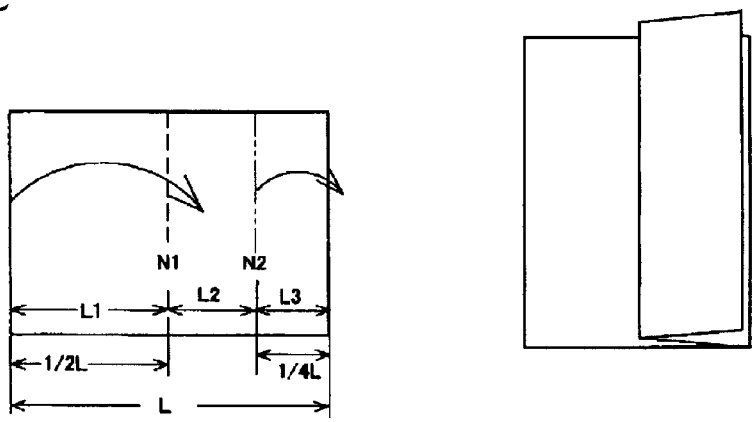

Specifically, as shown in FIGS. 4B and 4C, by adjusting the outer folding position N2 so that a relationship of L2<L3 exists, the folded back portion can be projected to the outside of the folded sheet. Also, if the outer folding position N2 is adjusted so that a relationship of L2>L3 exists, the folded back portion can be pulled inside the folded sheet. When in the bookbinding finish mode, the folding position computing means 73 that sets the folding position N at that time sets the folding position using the first control mode; when in the finishing process mode or sheet folding mode, it sets the folding position using the second control mode.

Folding Unit Configuration

The structure of the folding unit B1 will be now explained with reference to FIG. 2. The folding process path P2 is linked to the sheet conveyance path P1 interposed by a path switching flapper 24; the folding roller mechanism (the sheet folding means, and that applies below) 21 is disposed in the folding process path P2. A folded sheet path 23 branched in a T-shape is furnished to the folding process path P2 at a central position of the path, and a switchback path 22 is furnished downstream at a leading end of the folding process path P2. The folding roller mechanism 21 is furnished at the path branching point. The folding roller mechanism 21 shown in the drawing is composed of a first roller 21*a*, a second roller 21*b*, and a third roller 21*c*. The first and second rollers 21*a* and 21*b* are in mutual contact to nip the sheet; the second and third rollers 21*b*, and 21*c* are also in mutual contact to nip the sheet. Therefore, a first folding process is executed at the nipping point Np1 (the first folding unit) between the first and second rollers 21*a*, and 21*b*, and a second folding process is executed at the nipping point Np2 (the second folding unit) between the second and third rollers 21*b*, and 21*c*.

A conveyance roller 25 that conveys the sheet is disposed in the folding process path P2; the folding roller mechanism 21 is positioned downstream of the conveyance roller. A switchback roller 22*f* that is capable of both forward and reverse rotations and a sheet sensor SS1 are disposed in the switchback path 22 downstream of the folding process path P2. The sensor SS1 detects the leading edge of the sheet fed downstream (FIG. 2) by the switchback roller 22*f*. After detecting the leading edge of the sheet, the switchback roller 22*f* further conveys the sheet a predetermined amount and then stops. Then, the ¼ position of the sheet is bowed by the conveyance roller 25 continuing to rotate, thereby causing the bowed ¼ position of the sheet to enter the nipping point of the first folding unit Np1 of the folding roller mechanism 21. Next, the switchback roller 22*f* is driven in reverse thereby backing up the leading edge of the sheet. At the same time as that reverse drive, the conveyance roller 25 continues to feed the trailing edge of the sheet. These two actions cause the sheet to enter nipping point between the first and the second rollers 21*a* and 21*b*. These rollers pull the sheet downstream into the folded sheet path 23.

On the other hand, a trailing edge registration stopper 25S is provided downstream of the conveyance roller 25 to calculate the folding position based on the trailing edge of the sheet. After the trailing edge of the sheet is fed past the registration stopper 25S by the switchback roller 22*f*, the switchback roller 22*f* rotates in reverse thereby abutting the trailing edge of the sheet against the registration stopper 25. This causes the sheet to form a bow based on the sheet's trailing edge position. The bowed portion advances into the nipping point Np1 of the first and second rollers 21*a*, and 21*b* (the first folding unit). Thus, the first folding process is executed based on the trailing edge of the sheet. Note that the sheet stopper mechanism is composed of a flapper-shaped stopper 25S. This stopper 38 is configured to retract from the path when the sheet advances downstream in the folding process path P2, and to advance back into the path when the sheet is being conveyed upstream to stop the trailing edge of the sheet. This stopper that registers the trailing edge of the sheet can also be composed of the conveyance roller 25 as a switchback roller capable of forward and reverse rotations. Switchback roller 22*f* at the leading end of the path can also be configured for position registration.

Sheets whose folding positions are calculated by either their leading edge or their trailing edge when supplied to the first folding unit Np1 are folded by the first and second folding rollers 21*a*, and 21*b*, and then conveyed into the folded sheet path 23. A sheet detection sensor SS2 and movable stopper 23S are disposed in the folded sheet path 23. The movable stopper 23S is configured to move into the folded sheet path 23 to register the leading edge position of the sheet according to the sheet size and folding specifications. The leading edge of the folded sheet fed by the first and second rollers 21*a*, and 21*b* abuts the movable stopper 23S and is registered. This also forms a bow in the trailing edge side. This bow causes the sheet to advance into the nipping point between the second 21*b* and third roller 21*c* so the trailing edge side of the sheet is folded. A first discharge path P4 is disposed downstream of the nipping point (the second folding unit) Np2 of the second and third rollers 21*b* and 21*c*. Sheets folded at the first and second folding units Np1, Np2 are conveyed out to the first discharge path P4. Note that in the event that the sheet does not require a second folding, for example if only a single fold is applied to the sheet, the movable stopper 23S retracts to a non-operational, standby position so that the sheet can be conveyed out to the first discharge path P4 without being folded at the nipping position of the second and third rollers 21*b* and 21*c*.

The first discharge path P4 is equipped with a conveyance out rollers 27*b*. These roller nip the folded sheet and convey it to downstream. A folded sheet storage tray 29 and a second discharge path P5 are disposed downstream of the first discharge path P4 interposed by path switching member 29*f*. Conveyance rollers 27*c* are disposed at proper intervals in the second discharge path P5 to convey a folded sheet to the sheet conveyance path P1.

Inserter Configuration

As described above, a printed sheet is conveyed in from the image-forming unit A to the folding unit B1 but in addition to this, a sheet can be selectively conveyed from the inserter E for the folding process. As shown in FIG. 1, the inserter B3 is composed of a feeder tray 28*a* where sheets such as cover sheets or a divider sheet can be set; a separating means 28*b* that separates and feeds one sheet on the tray at a time; and the paper feed path P3 that guides the separated sheet to the sheet conveyance path P1. The separating means 28*b* is ordinarily composed of a friction roller (paper feed roller) and separating roller; a registration roller 28*c* is disposed downstream thereof. Therefore, it is possible to guide a sheet from a different printing process, not supplied from the image-forming unit A, or to set a cover sheet in the feeder tray 28*a* to insert in front and behind sheets. It is also possible to set divider sheets in feeder tray 28 to insert the dividers into the sheet conveyance path P1 for insertion between the pages at appropriate times.

Sheet Folding Operation

The following will now explain actions of the sheet folding unit B configured as described above. The present invention has the possibility of trimming a folding position N when trimming to align the edges of sheets bound in the bookbinding process when a sheet has been applied with a Z-fold, when applying the bookbinding process at the bookbinding unit C, on sheets folded into a Z-fold at the sheet folding unit B. The present invention has a feature of setting the sheet folding position N according to the trimming amount.

The following will explain folding operations to fold a sheet into a Z-fold at the sheet folding unit B. The control unit 59 of the sheet-folding unit B is composed of a control CPU. The control unit 59 can be integrated to the control unit 70 of the image-forming unit A or the control unit 75 of the bookbinding unit C, or it can be furnished separately to the sheet-folding unit B. A ROM 74 that stores folding execution programs and a RAM 77 that stores control data are provided in the control unit (control CPU) 59. The folding execution program executes folding processes with the folding specifications described above by controlling the conveyance roller 25 of the folding process path P2, the conveyance out rollers 27*b*, the folding roller mechanism 21 and the movable stopper 23S. This folding process execution program selects whether to move the folded sheet fed into the first discharge path P4 from the first discharge outlet 27*a* to the folded sheet storage tray 29 or to move the folded sheet from the second discharge path P5 to the bookbinding unit C according to the folding specifications, at the same time as executing a folding process described above. The drawings show sheet sizes of A4 or letter size. The sheet is conveyed from the first discharge path P4 and is stored in the folded sheet storage tray 29 for gate fold folding specifications. For other folding specifications, the sheet is conveyed out from the second discharge path P5 to the bookbinding unit C.

When a gate fold is applied to the sheet, the control unit (control CPU) 59 discharges the sheet from the discharge outlet 14 of the image-forming unit A facing downward. The sheet is handed over and conveyed into the folding process path P2 in the manner indicated by arrow a in FIG. 2. Next, the sheet passes through the folding roller mechanism 21 and advances into the switchback path 22 downstream. At the point where the leading edge of the sheet is conveyed a predetermined amount downstream, the switchback roller 22*f* is driven in reverse while the conveyance roller 25 is stopped. At that point, the trailing edge of the sheet is restrained by the conveyance roller 25, and the center of the sheet is bowed in the direction of the nipping point Np1 between the first and second rollers 21*a* and 21*b*. The sheet is nipped between the both rollers, and the first folding process is executed therebetween. By adjusting the distance between amount of feeding of the switchback rollers 22*f* and the nipping point N2, the outside folding position N in FIGS. 4B, (c) is set. Specifically, the sheet sensory detects the leading edge of the sheet, the control CPU59 rotates the switchback roller 22*f* in reverse after an estimated amount of time after that signal for the sheet folding position N2 to reach the nipping point Np1. At that time, the leading edge of the sheet is folded between the second rollers 21*a*, 21*b* at the folding position N facing outward.

In this way, the sheet folded to face outside is fed to the folded sheet path 23 by the first and second rollers 21*a*, 21*b*. At this time, the CPU59 moves the movable stopper 23S using a drive motor, not shown, to align the distance of the sheet folding position and the nipping point Np2 to the inner folding position N2 (see FIG. 4) set according to the sheet size. Therefore, the leading edge (the folded position) of the sheet folded by the first folding unit Np1 abuts the movable stopper 23S and the center portion of the sheet is nipped between the first and second rollers 21*b*, 21*c*. The printed surface of the sheet is folded inward by the second and third rollers 21*b*, 21*c* and the distance between the nipping point Np2 and the movable stopper 23S is set to L2 of the length of the sheet, shown in FIG. 4. Therefore, the leading edge of the sheet faces outward and the trailing edge of the sheet is Z-folded inward. Sheets folded in this manner are fed from the second discharge path P5 to the bookbinding unit C where the bookbinding process is performed.

Bookbinding Unit Configuration

The following will now explain the bookbinding unit C that is attached to the image-forming unit A. The bookbinding unit C is composed of a stacker 40 that stacks and aligns printed sheets into bundles; an adhesive applicator means 55 that applies adhesive to the sheet bundle conveyed from the stacker 40; and cover sheet binding means 60 that binds the cover sheet to the sheet bundle applied with adhesive, in the casing 30.

Conveyance Path Configuration

A conveyance path 31 having a conveyance inlet 31*a* linked to the discharge outlet 14 of the image-forming unit A is provided in the casing 30, and the intermediate sheet conveyance path 32 and cover sheet conveyance path 34 are linked from this conveyance path 31 via the path switching flapper 36. The bookbinding path 33 is linked to the cover sheet conveyance path 34 via the stacker 40, and a finishing path 39*a* is connected to the cover sheet conveyance path 34. The bookbinding path 33 is disposed to traverse the apparatus longitudinally in a substantially vertical direction, and the cover sheet conveyance path 34 is disposed in a direction to traverse the apparatus in a horizontal direction.

The bookbinding path 33 and the cover sheet conveyance path 34 mutually intersect (orthogonally); the cover sheet binding means 60, described below, is disposed in the intersection. The conveyance path 31 configured as described above is linked to the discharge outlet 14 of the image-forming unit A to receive printed sheets from the image-forming unit A. Sheets printed with content information (the leaves of sheets), and sheets printed with a title and the like to be used as a cover sheet (hereinafter referred to as a cover sheet) are conveyed out from the image-forming unit A. This conveyance path 31 is branched into the intermediate sheet conveyance path 32 and the cover sheet conveyance path 34, and sort printed sheets to convey them into each path by the use of a path switching flapper 36.

Stacker Configuration

The stacking tray 44 arranged at the discharge outlet 32*b* of the intermediate sheet conveyance path 32 stacks and stores sheets from the discharge outlet 32*b* in a bundle. As shown in FIG. 3, the stacking tray 44 is composed of a tray member disposed in substantially horizontal posture; a forward and reverse rotating roller 42*a* and conveyance guide 42*b* are furnished thereabove. Also, printed sheets from the discharge outlet 32*b* are guided to the stacking tray 41 by the conveyance guide 42*b* and are stored by the forward and reverse rotating roller 42*a*. The forward and reverse rotating roller 42*a* feeds the printed sheet to the leading edge of the stacking tray 41 with a forward rotation. When rotated in reverse, the trailing edge of the sheet is pushed against an aligning member 43 disposed at the trailing edge of the tray (the right edge of FIG. 1) to become aligned. A sheet side aligning means, not shown, is equipped on the stacking tray 41 to align both edges of the printed sheet stored in the tray to reference positions. With this configuration, printed sheets conveyed from the inner-sheet conveyance path 32 are sequentially stacked in the stacking tray 41 and aligned into a bundle shape.

Configuration of Sheet Bundle Conveyance Means

Gripping conveyance means 47 are furnished in the bookbinding path 33 to convey a sheet from the stacking tray 41 to a downstream adhesive application position F. As shown in FIG. 3, the gripping conveyance means 47 turns the sheet bundle stacked on the stacking tray 41 from a horizontal posture to a vertical posture, then conveys the sheet bundle to the adhesive application position F by conveying it along the bookbinding path 33 disposed in a substantially vertical direction. For that reason, the stacking tray 41 moves from a stacking position (solid lines in FIG. 3) to the hand-over position (dashed line in FIG. 3), and hands over the sheet bundle to the gripping conveyance means 47 prepared at this hand-over position.

Adhesive Application Unit Configuration

Figure 6A:
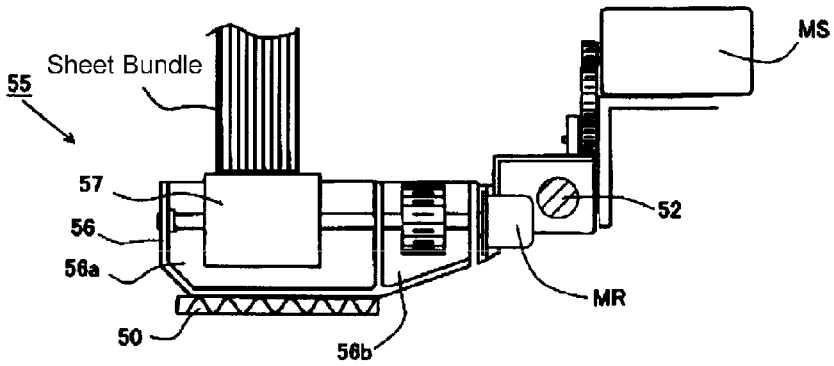
FIGS. 6A and 6B are explanatory views of an adhesive applicator means in the unit shown in FIG. 3.
Figure 6B:
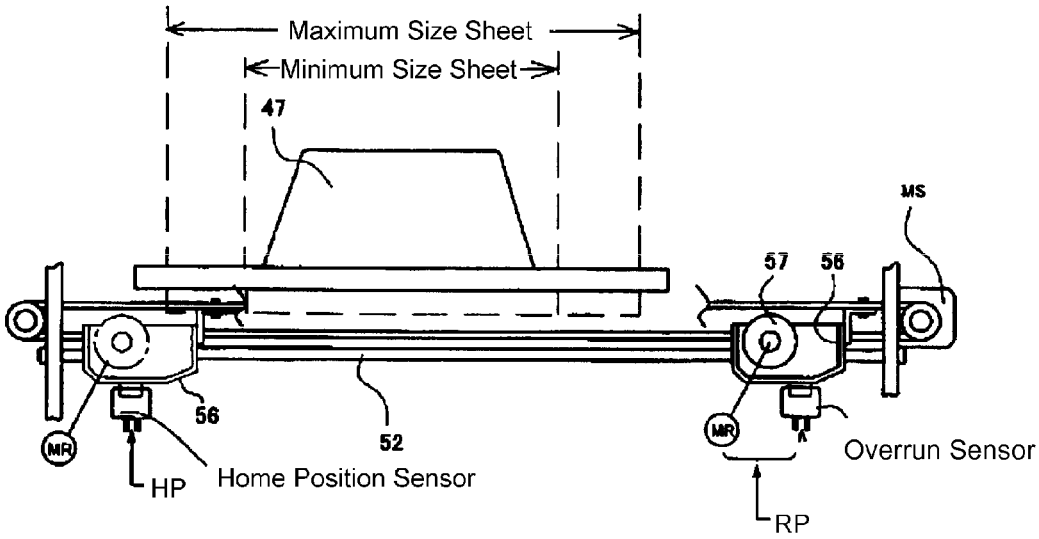

An adhesive application means 55 is disposed in the adhesive application position F of the bookbinding path 33. As shown in FIG. 6A the adhesive application means 55 is composed of an adhesive container 56 that stores hot-melt adhesive; an applicator roller 57; and a roller rotating motor MR. Adhesive is stored in the adhesive container's 56 liquid adhesive storage chamber. This adhesive impregnates the applicator roller 57 and is applied to a spine edge of the sheet bundle. The symbol 56S in the drawing is the temperature sensor. This maintains a predetermined temperature for liquefaction of the adhesive in the container. Also, heating means 50, such as an electric heater or the like, is embedded in the adhesive container 56. The adhesive container 56 is supported on a guide rail 52 of the apparatus frame to move along the bottom edge of the sheet bundle. A drive motor MS installed on the apparatus frame is connected to the adhesive container 56. Therefore, drive motor MS reciprocates the adhesive container 56 between a home position HP and a return position RP where the return operation is started along the sheet bundle.

Configuration of Cover Sheet Binding Means

Figure 7:
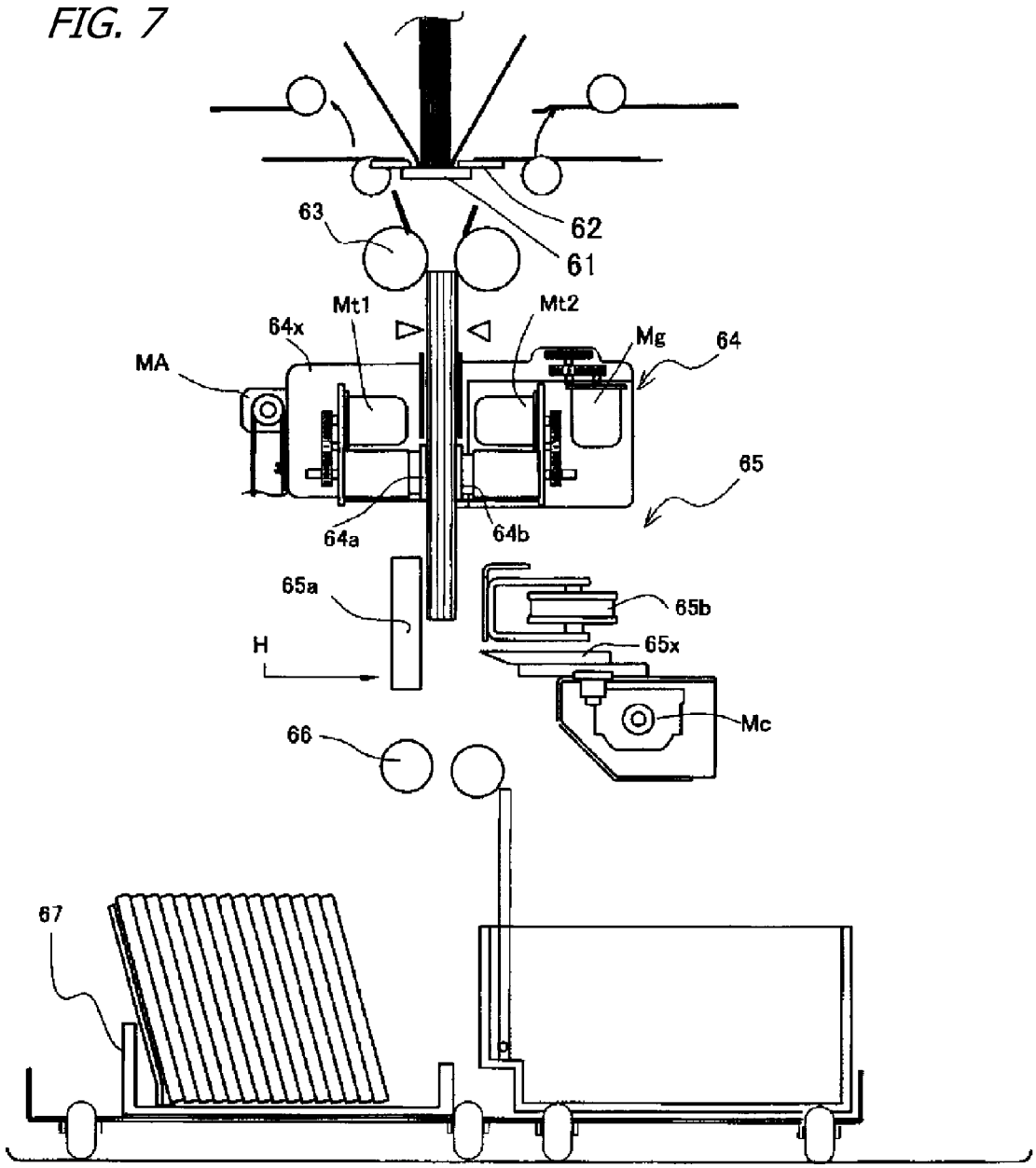
FIG. 7 is a block schematic view of a cover sheet binding means, sheet bundle orientation deviation means; and trimming means in the unit shown in FIG. 3.

The cover sheet binding means 60 is disposed in the cover sheet binding position G of the bookbinding path 33. As shown in FIG. 7, the cover sheet binding means 60 is composed of a spine support plate 61, cover sheet folding plates 62, and folding rollers 63. The cover sheet conveyance path 34 described above is disposed in the cover sheet binding position G, and conveys cover sheets from the image-forming unit A or the inserter unit E. The spine support plate 61 is composed of a plate-shaped member that backs-up the cover sheet and is able to advance into and retract from the bookbinding path 33. The inner sheet bundle is joined in an upside-down T-shape to the cover sheet supported on the spine support plate 61. The cover sheet folding plates 62 are composed of a pair of left and right side pressing members. Drive means, not shown, are composed to come together and separate to fold and form the backside of the cover sheet joined in an upside-down T-shape. The folding rollers 63 are composed of are composed of a pair of rollers that finish the cover by sandwiching the sheet bundle joined with the cover sheet.

Configuration of Bundle-Posture Changing Means

A bundle posture changing means 64 that turns the sheet bundle over from top to bottom, and trimming means 65 that cuts the edges of the sheet bundle are disposed in the trimming position H positioned downstream of the folding rollers 63. The bundle posture changing means 64 turns the covered sheet bundle fed from the cover sheet binding position F to a predetermined direction (or posture) and conveys the sheet bundle downstream to the trimming means 65 or the storage stacker 67. The trimming means 65 trims the fringes of the sheet bundle to align the edges. Therefore, the bundle posture changing means 64 is equipped with rotating tables 64*a*, 64*b* that grip and turn the sheet bundle fed from the folding rollers 63. As shown in FIG. 7, the rotating tables 64*a*, 64*b* are established on the unit frame 64*x* installed on the apparatus frame to rise and lower. The pair or rotating tables 64*a*, 64*b* that sandwich the bookbinding path 33 are rotatably supported on bearings in the unit frame 64*x*; one of the movable rotating tables 64*b* supported to move in a sheet bundle thickness direction (a direction orthogonal to the bookbinding path 33). Spinning motors Mt1, Mt2 are furnished in the bookbinding path 33 for the rotating tables 64*a*, 64*b* to change the posture of the sheet bundle. A grip motor Mg is provided for the movable side rotating table 64*b* to move in the left and right directions of FIG. 7.

Therefore, the sheet bundle guided to the bookbinding path 33 is gripped by the pair of left and right rotating tables 64*a*, 64*b*, then the posture of the sheet bundle is changed by the turning motors Mt1, Mt2. For example, the sheet bundle with its spine portion conveyed downward is rotated 180 degrees and fed to downstream discharge rollers 66 with the fore-edge portion facing downward. The sheet bundle is sequentially rotated 90 degrees to turn the sheet bundle's top and bottom and fore-edge portion at a downstream trimming position G to enable the trimming of three edge directions of the sheet bundle. Note that a grip sensor (not shown) is provided on the rotating table 64*b* of the movable side. This detects that the sheet bundle has been securely gripped between the left and right side rotating tables 64*a*, 64*b*. After detection, the rotating tables 64*a*, 64*b* are configured to revolvingly drive. Also, the unit frame 64*x* raises and lowers the sheet bundle along the bookbinding path 33 using an elevator motor MA. This is to configure a jog mechanism to offset a predetermined amount the sheet bundle fed by the discharge rollers 66 and convey the sheet bundle to a trimming position H when trimming edges of the sheet bundle, and to set the trimming width at the trimming position H by that feed amount.

Configuration of Trimming Means

Trimming means 65 are provided downstream of the bundle posture changing means 64. As shown in FIG. 7, the trimming means 65 is composed of trimming edge pressing member 65*b* that pressingly supports the trimming edge of the sheet bundle to a blade-edge bearing member 65*a* and a trimming blade unit 65*c*. The trimming edge pressing member 65*b* is disposed in a position that opposes the blade-edge bearing member 65*a* disposed in the bookbinding path 33, and is composed of a pressing member that moves in an orthogonal direction to the sheet bundle by drive means, not shown. The trimming blade unit 65*c* is composed of a flat, blade-shaped trimming blade and a cutter motor MC that drives that blade. The trimming means 65 with this configuration cuts a predetermined amount around the edges, excluding the spine of the sheet bundle that has been made into a booklet (hereinafter referred to booklet sheets), to align the edges.

Figure 5C:
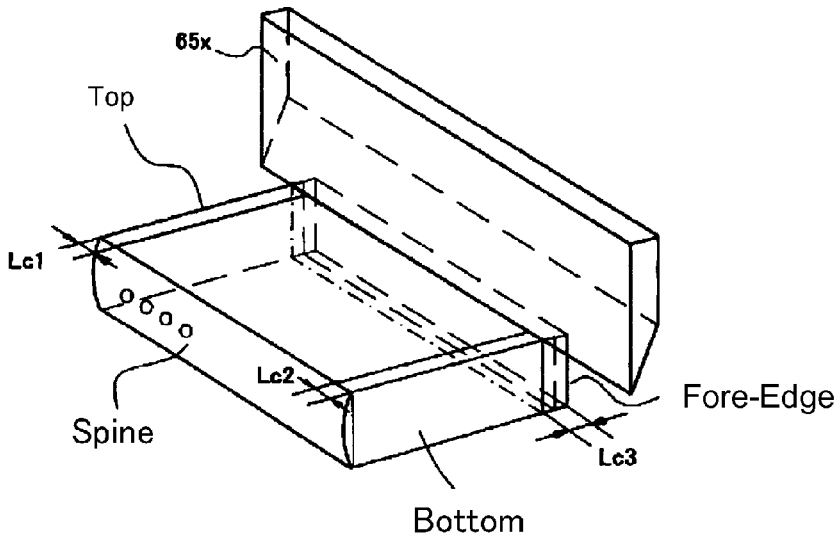

In the trimming to align the booklet sheets, the top portion of the booklet sheets is cut with the trimming amount Lc1, as shown in FIG. 5C, then the rotating tables 64*a*, 64*b* are turned 180 degrees to cut the bottom portion of the booklet sheets with the trimming amount Lc2. These trimming amounts Lc1, Lc2, are calculated by Lc1=Lc2 [[(inner sheet size)−(finished size)]÷2], for example. Next, the rotating tables 64*a*, 64*b* are rotated 90 degrees to cut the fore-edge portion with the trimming amount Lc3. The trimming amount Lc3 is calculated by Lc3=(inner sheet size)−(finished size), for example.

On the other hand the cover sheet trimming amount is calculated in the same way as described above. The trimming amount Ld3 of the fore-edge portion of the cover sheet is calculated by Ld3=[[(inner sheet size)−(bundle thickness)]÷2−(finished size)], for example. The trimming amount Ld of the cover sheet and the trimming amount Lc of the inner sheets are calculated for each, and the longer of the two is set to the trimming position to execute the trimming process. The trimming amount computing means 78, described below, is configured in this way.

Finisher Configuration

The bookbinding unit C is arranged in the finishing unit D. The finishing path 39*a* is connected to cover sheet conveyance path 34 for the finishing unit D, and a finisher, such as a staple unit, punch unit, and stamp unit or the like, is disposed in the finishing path 39*a*. Printed sheets are received from the image-forming unit A via the cover sheet conveyance path 34 and are stapled, punched or applied with a mark, then conveyed to the discharge tray 37. It is also possible not to apply any finishing process on printed sheets and to store them in the discharge tray 37 directly from the image-forming apparatus A.

Configuration of Control Means

Figure 8:
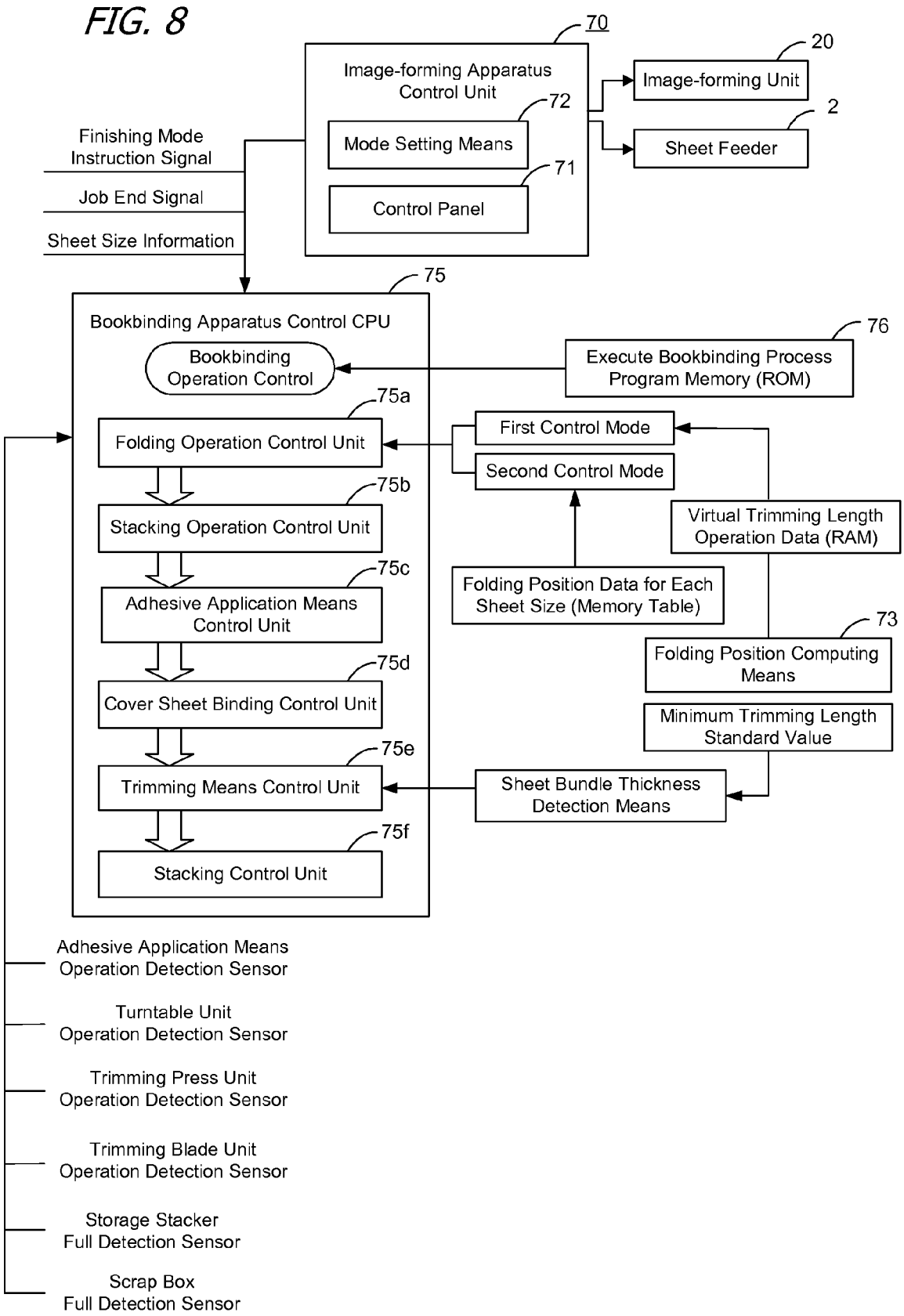
FIG. 8 is a block diagram of a configuration of a control unit in the system shown in FIG. 1.

The configuration of the control means in the apparatus described above will now be explained with reference to FIG. 8. The present invention described above is configured to calculate the folded position according to the trimming amount when sheets are folded to a Z-fold, when the system is set to a mode for bookbinding sheets conveyed from the image-forming unit. FIG. 8 is a block diagram to assist in describing the conveyance of the control means. As shown in FIG. 1, in the system that connects the image forming unit A, the sheet folding unit B and the bookbinding unit C, a control panel 71 and mode selection means 72 are furnished on the control unit CPU70 equipped on the image forming apparatus A, for example. A control CPU75 is equipped in the control unit of the bookbinding unit C. This control CPU75 calls up a bookbinding execution program from the ROM76 and executes each process in the bookbinding path 33.

This control CPU75 receives a finishing mode instruction signal, job end signal, sheet size information, and other information and command signals required in the bookbinding process from the control CPU70 of the image-forming unit A. On the other hand, sheet sensors Se1 to Se6 are arranged in the positions shown in FIG. 3 to detect the sheets (sheet bundle) conveyed to the conveyance path 31, bookbinding path 33, and cover sheet conveyance path 34. Detection signals from the sheet sensors Se1 to Se6 are transmitted to the control CPU75; the control CPU75 is equipped with "folding operation control unit 75*a*;" "stacking operation control unit 75*b*;" "adhesive application operation control unit 75*c*;" "cover sheet operation control unit 75*d*;" "trimming operation control unit 75*e*;" "stack operation control unit 75*f*;" "folding predetermined position calculating means 73;" and "trimming amount calculation means 78." The bookbinding process is executed according to the flowchart shown in FIG. 9.

Configuration of Trimming Amount Calculation Means

The trimming amount calculation means 78 is configured in the control CPU75, and calculates the amount of the edges of the sheet bundle to trim after the bookbinding process. For that reason, the trimming amount calculation means 78 receives the folding specifications information and sheet size information set by the mode on the image-forming unit A from the control unit 70 of the image-forming unit A.

To explain this with reference to FIG. 8, the trimming amount calculation means 78 receives size information of the inner leaves of sheets not folded (hereinafter referred to as inner sheets) and size information of the cover sheet from the control unit 70 on the image-forming unit A. On the other hand, the trimming amount calculation means 78 receives the bookbinding finishing size information transferred from the image-forming unit A. This finishing size is specified from either of the trimming conditions of whether the size information is what the operator selected such as JIS standard A5 size and the like for example, or a preset trimming amount of "α mm (it is acceptable for the operator to specify 5 mm, for example)."

The trimming amount calculation means 78 calculates the (1) inner sheet trimming amounts (hereinafter called the length) Lc1, Lc2 and Lc3 according to the trimming conditions above from that information. The calculating method is as described above when the finishing size is specified. (2) Next, the trimming amount calculation means 78 calculates the cover sheet trimming amount Ld1 (top), Ld2 (bottom), and Ld3 (fore-edge portion). In such a case, the bundle thickness of the inner sheets is considered.

Next, the trimming amount calculation means 78 compares the inner sheet trimming amount Lc and cover sheet trimming amount Ld with the top, bottom and fore-edge portion sides to set the longest of the inner sheet and cover sheet to the actual trimming amount. Note that such calculation of the trimming amount differs according to the system configuration. For example, if the size of sheet specified by the image-forming unit A is not prepared, and the bookbinding process is executed by printing on a size of sheet that is larger than the specified size and the excess portions are trimmed, it is necessary for the operator to specify "finished size."

Configuration of Folding Position Calculating Means

Next, the folding position calculating means 73 is configured in the control CPU75, and calculates the folded position of the sheets folded at the sheet folding unit B. To explain with reference to FIG. 8, when folding a sheet to a Z-fold, the folding position calculating means 73 calculates the inner-facing folding position N1 and the outer-facing folding position N2, as described above. The length L1 to the spine edge and inner-facing folding position and the length L3 to the front edge portion and outer-facing folding position are calculated. This calculation is done using L1=L3 [[(sheet size)−(binding amount)÷3] when the folding specifications are set to a Z-fold. If the folding specifications are set for ¼ Z-fold, this calculation is done using L1=[(sheet size)÷2], and L3=[(sheet size)÷4]. The present invention has a feature to set the actual folding position from the above calculation values of L1, L3, and the trimming amount (Lc or Ld described above).

In other words, when L1 (the length of the spine edge and the inner-facing folding position) is smaller than the length of the bookbinding finishing size, the calculated folding length is set to the inner-facing folding position N1. Also, when this L1 is L1≧bookbinding finishing size, this is set to L1=(bookbinding finishing size=β). Note that β is set to a preset, arbitrary value, considering discrepancy of the trimming position. By setting to this, the inner-facing folding position N1 (see FIG. 4) is set to a size smaller than the bookbinding finishing size, and the folding position will not be cut off when performing the subsequent trimming process.

Explanation of Bookbinding Operation

Figure 9:
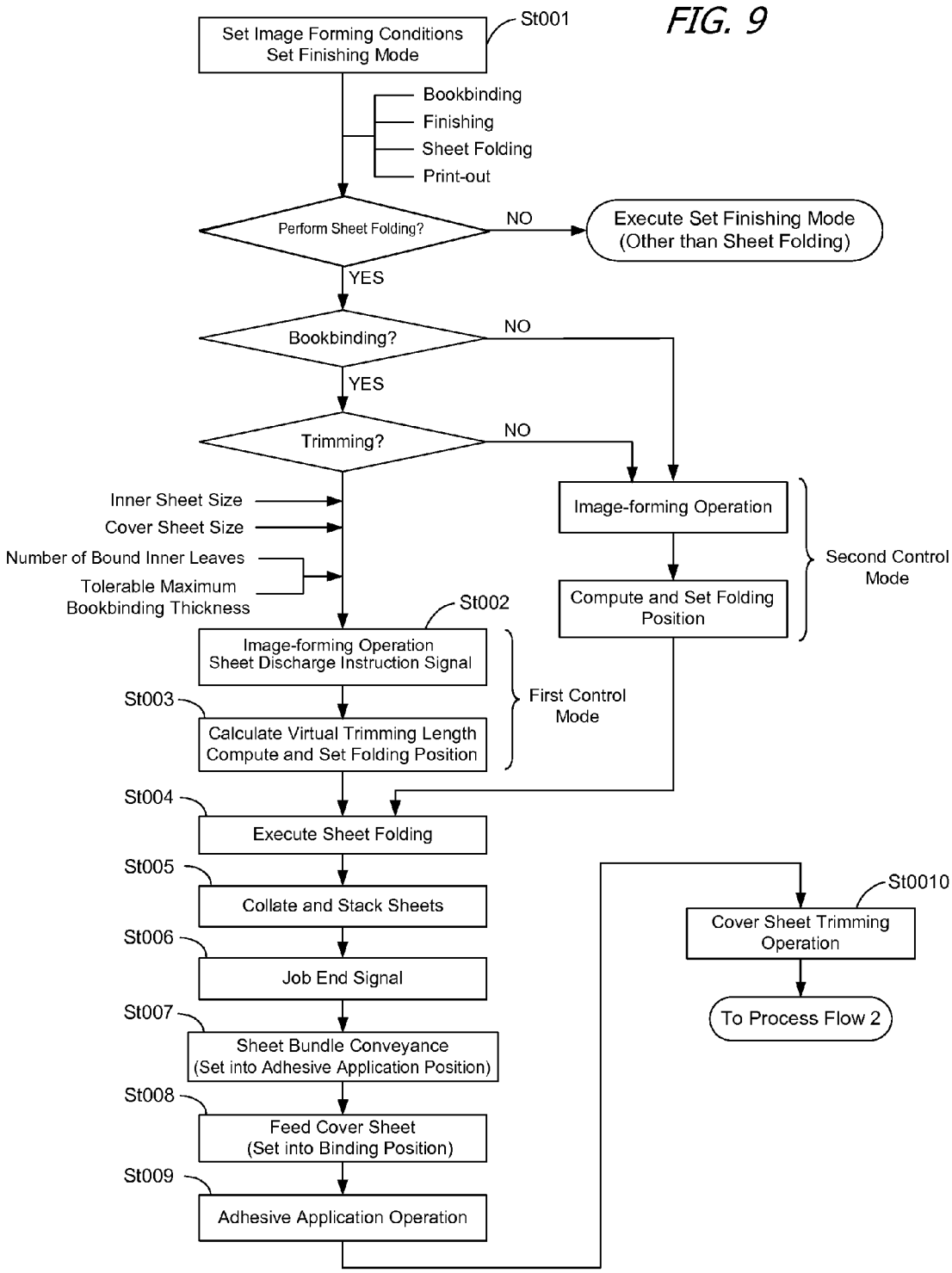
FIG. 9 is a flowchart of a bookbinding operation in the system shown in FIG. 1.
Figure 10:
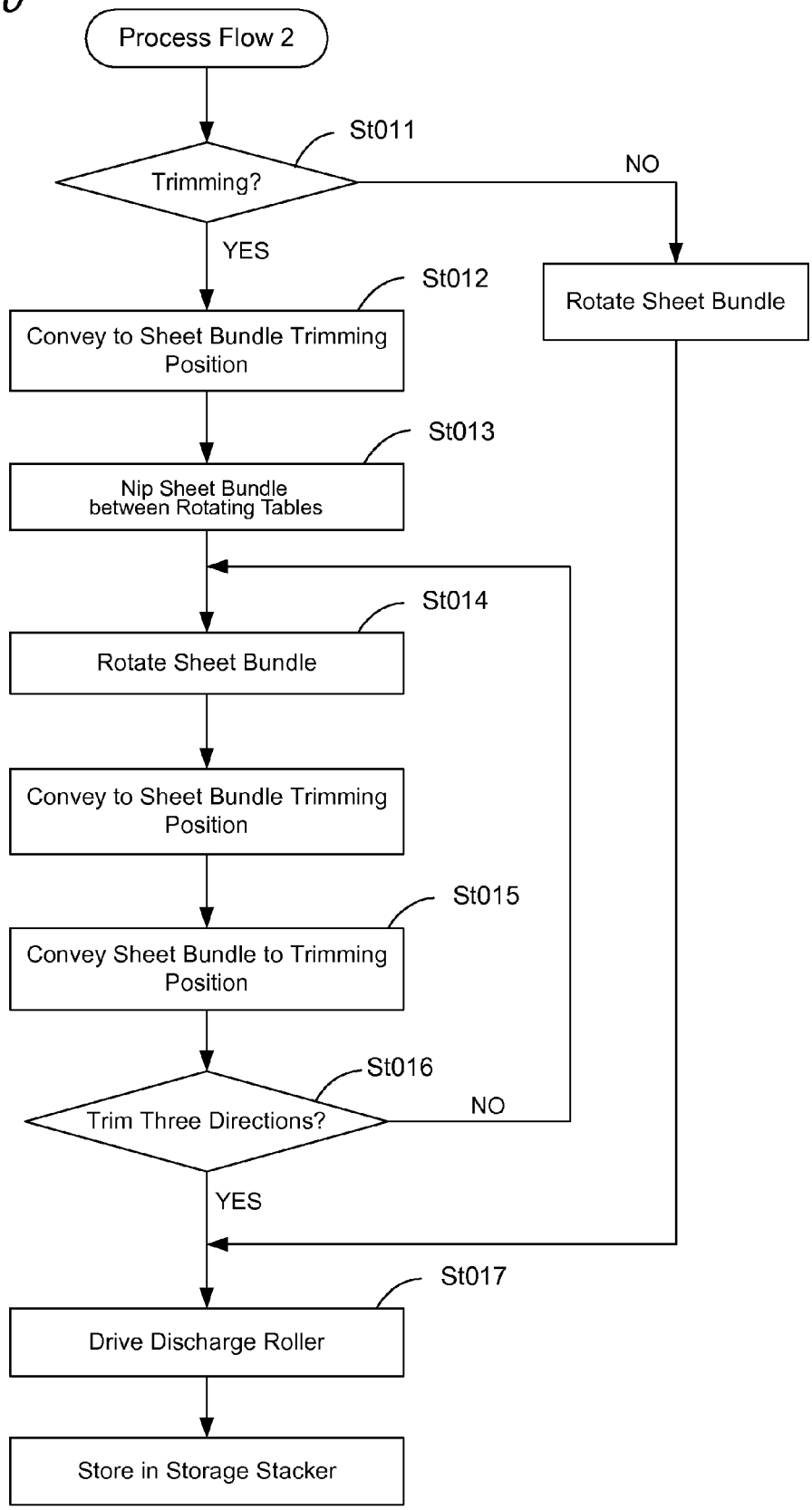
FIG. 10 is a flowchart of the bookbinding operation in the system shown in FIG. 1.

Next, the bookbinding process operations using the control CPU75 will now be explained with reference to the flowchart block diagram of FIG. 9. Image forming conditions and a finishing mode are set (St001) using the control panel 71 on the image-forming apparatus A. "Print-out mode," "bookbinding mode," "staple mode," "marking mode," "hole-punching mode," and "jog mode" can be set as the finishing mode, for example. At the same time as this, folding specifications whether to fold the sheet is set according to the sheet size.

In the print-out mode, a sheet formed with an image does not undergo the bookbinding process or the finishing, and is conveyed out to the discharge tray 37 (equipped on the finisher unit D shown in the drawings) and stored. With the bookbinding mode, sheets formed images are aligned and stacked, then joined with a cover sheet and stored in the storage stacker 67. Also, in the staple mode, sheets formed with images are stapled by a stapling unit equipped in the finisher unit D; in the marking mode, a mark is applied; in the hole-punching mode, holes are punched in the sheets; and in the jog mode, sheets are sorted. Each of these modes is executed by the finisher unit D, and then the finished sheets are stored in the discharge tray 37.

When the bookbinding mode is selected and the finishing mode, an image forming operation is executed by the image-forming unit A, and the sheet formed with images is conveyed out from the discharge outlet 14. (St002) With the bookbinding unit C, this sheet is received in the conveyance path 31. At this time the CPU75 positions the path switching flapper 36 in the state shown in FIG. 3 to guide the sheet to the intermediate sheet conveyance path 32. The sheet is fed to the discharge outlet 32*b* by the conveyance rollers 32*a* and sequentially stacked and stored in the stacker 41.

In parallel to the forming of images on the sheet, the control CPU75 calculates the trimming amounts Lc, Ld explained with reference to FIG. 8, and the folding positions N1, N2 (St003). When the "folding mode" is set for sheets conveyed from the image-forming unit A, the sheets are guided to the sheet folding unit B and the sheets are folded by the set folding specifications (St004). The folded sheet is conveyed to and stored in the stacking tray 41 (St005).

There, when the job end signal (St006) is received from the image-forming unit A, the control CPU75 conveys the sheet bundle on the stacking tray 41 by the gripping conveyance means 47 to turn the sheet bundle posture 90 degrees. This changes the posture of the sheet bundle collated on the stacking tray 41 form a horizontal orientation to a vertical orientation to be conveyed over the bookbinding path 33 to the downstream adhesive application position F (St007).

The control CPU75 conveys a cover sheet from the cover sheet conveyance path 34 at the time the sheet bundle is conveyed to and set at the adhesive application position F. This cover sheet can be fed after being formed with an image at the image-forming unit A, or fed from the inserter unit E.

The sheet fed by the sheet feed path P3 is conveyed to the conveyance path 31. At this time the CPU75 positions the path switching flapper 36 in the state shown in FIG. 1 to guide the sheet to the cover sheet conveyance path 34. A registration mechanism (not shown) is furnished in the cover sheet conveyance path 34 to correct the posture of the sheet; sheets aligned by the registration mechanism are conveyed a predetermined distance from that position to reach the cover sheet binding position G and are stopped there (St008). After the conveyance and setting of the cover sheet, the control CPU75 drives the adhesive application means 55 to apply adhesive to the sheet bundle set at the adhesive application position F (St009). The adhesive container 56 equipped with the applicator roller 57 moves along the bottom edge of the sheet bundle to apply adhesive coated on the roller surface onto the sheet bundle.

After finishing the adhesive application operation, the control CPU75 conveys the sheet bundle to the downstream cover sheet binding position G using the gripping conveyance means 47. When this happens, the cover sheet is set at that position so the cover sheet is backed up by the spine support plate 61 and joined to the sheet bundle in an upside-down T-shape. Next, the sheet bundle covered by the folding plates 62 press-forming the backside of the cover sheet.

After the covering process above, the control CPU75 determines whether a trimming mode has been selected (St011). For the trimming mode, the gripping conveyance means 47 releases from the sheet bundle and returns to its default position. A trimming blade 65*x* is positioned at the trimming position H and stops the descending sheet bundle (St012). In this state, the movable rotating table 64*b* moves from the standby position to a sheet gripping position to nippingly hold the sheet bundle between itself and rotating table 64*a* (St013). Next, after the control CPU75 moves the trimming blade 65*x* to the standby position, it revolves the rotating tables 64*a*, 64*b* to turn the sheet bundle so that its top is at the bottom side (St014). There, the trimming edge pressing member 65*b* pressingly holds the sheet bundle and the trimming blade 65*x* buts a predetermined amount (St016).

Next, the control CPU75 retracts the trimming edge pressing member 65*b* to the standby position, then turns the sheet bundle 180 degrees so that the other side is at the bottom to cut the bottom portion. Next, the control CPU75 retracts the trimming edge pressing member 65*b* to the standby position, then turns the sheet bundle 90 degrees so that the other side is at the bottom to cut the bottom portion. After the sides of the sheet bundle are cut and aligned in this way, the control CPU75 ends trimming the three directions of the sheet bundle and shifts to the discharge operation (St017). On the other hand, at step St011 above, if there is no trimming mode selected, the control means 75 shift to the discharge operation.

Alternative Embodiment Of Image-Forming System

Furthermore, the present invention can attain aforementioned objects with the configuration described below. The folding position with the first control mode in the apparatus described above was set using a "virtual trim depth." The folding position in the first control mode can be configured as described below.

A trimming means that cuts and aligns the fore-edge portion of the sheet bundle bound to a cover sheet and trimming amount setting means that sets the amount of the fore-edge portion to cut using the trimming means are furnished. The folding position calculating means sets the folded position from the trim depth set by the trimming amount setting means when in the first control mode, and sets the folded position based on sheet size information from the image-forming means when in the second control mode. The folded position in the first control mode is set so that the distance of the length of the spine edge and the folding position is shorter than the distance of the length of the spine edge and the fore-edge portion edge after trimming.

With this configuration, when the first control mode is set, the folded position of the sheet will not be cut in the trimming process, and the same objects as described above can be attained. The present application claims priority rights from Japanese Pat. App. Nos. 2007-89282 and 2007-194363, which are herein incorporated by reference.

What is claimed is:

1. A bookbinding apparatus comprising:

sheet-folding means for folding over sheets delivered sequentially from an incoming sheet conveyance path;

stacking means for collating and stacking sheets from at least either said sheet-folding means or said incoming sheet conveyance path;

binding-process means for binding together spine-portion edges of a sheet block from said stacking means;

trimming means for trimming true the open edges of a sheet block that has been bound into a bundle;

folding-position computing means for determining sheet position of folds made by the sheet folding means; and trim-amount computing means for computing length to which said trimming means trims; wherein said folding-position computing means is configured to preestablish, when a sheet is Z-folded by said sheet folding means, the position where the sheet is folded inward toward its spine portion, based on the trim depth, gotten from said trim-amount computing means, for the sheet fore-edge portion.

2. The bookbinding apparatus according claim 1, wherein said folding-position computing means when computing the position where a sheet is folded inward toward its spine portion performs the computation so that the length of the inner fold position from the sheets' spine-portion edge will be shorter than the length of the sheets' fore-edge side from their spine-portion edge after being finished by trimming.

3. An image-forming system comprising:

an image forming apparatus for forming images onto sheets; and a bookbinding apparatus for collating and stacking sheets from said image-forming apparatus and binding the sheets into booklets; wherein said bookbinding apparatus is configured according to that of claim 2, said folding-position computing means and said trim-amount computing means are disposed either in said image-forming apparatus or said bookbinding apparatus.

4. The image-forming system according to claim 3, wherein according to length information from finished-booklet size, input through input means, length information for sheets onto images are formed by said image-forming apparatus, and length information for cover sheets supplied to said binding-process means, said trim-amount computing means computes depth of trimming by said trimming means.

5. The bookbinding apparatus according to claim 1, wherein:

in said stacking means inner-leave folded sheets from said sheet-folding means are stacked heterogeneously with non-fold-processed inner-leave simple sheets from said incoming sheet conveyance path;

a cover-sheet supply path along which are delivered cover sheets for encasing and binding inner-leave sheets from said stacking means is provided linked to a binding location in said binding-process means;

said trim-amount computing means computes both a cover-sheet trim depth and an inner-leave-sheet trim depth, derived from a pre-designated finished booklet size; and said trimming means trims the open edges of sheet bundles to a trim depth that is whichever is the longer of the cover-sheet trim depth and the inner-leave-sheet trim depth.

6. An image-forming system comprising:

an image forming apparatus for forming images onto sheets; and a bookbinding apparatus for collating and stacking sheets from said image-forming apparatus and binding the sheets into booklets; wherein said bookbinding apparatus is configured according to that of claim 5, said folding-position computing means and said trim-amount computing means are disposed either in said image-forming apparatus or said bookbinding apparatus.

7. The image-forming system according to claim 6, wherein according to length information from finished-booklet size, input through input means, length information for sheets onto images are formed by said image-forming apparatus, and length information for cover sheets supplied to said binding-process means, said trim-amount computing means computes depth of trimming by said trimming means.

8. The bookbinding apparatus according to claim 1, wherein said binding-process means is furnished with one among a stapling means, an adhesive application means, or an adhesive-tape binding means, for binding together the sheets in bundles collated by said stacking means, along their spine-portion endface.

9. An image-forming system comprising:

an image forming apparatus for forming images onto sheets; and a bookbinding apparatus for collating and stacking sheets from said image-forming apparatus and binding the sheets into booklets; wherein said bookbinding apparatus is configured according to that of claim 4, said folding-position computing means and said trim-amount computing means are disposed either in said image-forming apparatus or said bookbinding apparatus.

10. The image-forming system according to claim 9, wherein according to length information from finished-booklet size, input through input means, length information for sheets onto images are formed by said image-forming apparatus, and length information for cover sheets supplied to said binding-process means, said trim-amount computing means computes depth of trimming by said trimming means.

11. An image-forming system comprising:

an image forming apparatus for forming images onto sheets; and a bookbinding apparatus for collating and stacking sheets from said image-forming apparatus and binding the sheets into booklets; wherein said bookbinding apparatus is configured according to that of claim 1, said folding-position computing means and said trim-amount computing means are disposed either in said image-forming apparatus or said bookbinding apparatus.

12. The image-forming system according to claim 11, wherein according to length information from finished-booklet size, input through input means, length information for sheets onto images are formed by said image-forming apparatus, and length information for cover sheets supplied to said binding-process means, said trim-amount computing means computes depth of trimming by said trimming means.

* * * * *